United States Patent [19]

Hubers

[11] 3,939,652

[45] Feb. 24, 1976

[54] DEVICE COMPRISING AN EXPANSION ENGINE AND A SEPARATE APPARATUS FOR FEEDING SAID ENGINE

[76] Inventor: Cornelis Hubers, van Ostadelaan 2, Rozenburg, Netherlands

[22] Filed: Jan. 11, 1974

[21] Appl. No.: 432,670

Related U.S. Application Data

[63] Continuation of Ser. No. 193,636, Oct. 29, 1971, abandoned.

[30] Foreign Application Priority Data

Oct. 29, 1970 Netherlands ..... 70/15852

[52] U.S. Cl. ..... 60/39.63; 60/39.72 P; 60/39.73

[51] Int. Cl.[2] ..... F02G 3/02

[58] Field of Search ..... 60/39.63, 39.6, 39.61, 60/39.62, 39.72, 39.73

[56] References Cited

UNITED STATES PATENTS

| | | | |
|---|---|---|---|
| 980,801 | 1/1911 | Kraus | 60/39.63 X |
| 1,247,700 | 11/1917 | Mehle | 60/39.63 X |
| 2,688,230 | 9/1954 | Milliken | 60/39.63 |
| 3,651,641 | 3/1972 | Ginter | 60/39.63 |

*Primary Examiner*—Clarence R. Gordon

*Attorney, Agent, or Firm*—Stevens, Davis, Miller & Mosher

[57] ABSTRACT

The present invention relates to a device comprising an expansion engine, having at least one cylinder and a piston moving therein and a separate apparatus for feeding said expansion engine with combustion gases under pressure.

6 Claims, 4 Drawing Figures

Figure 1:
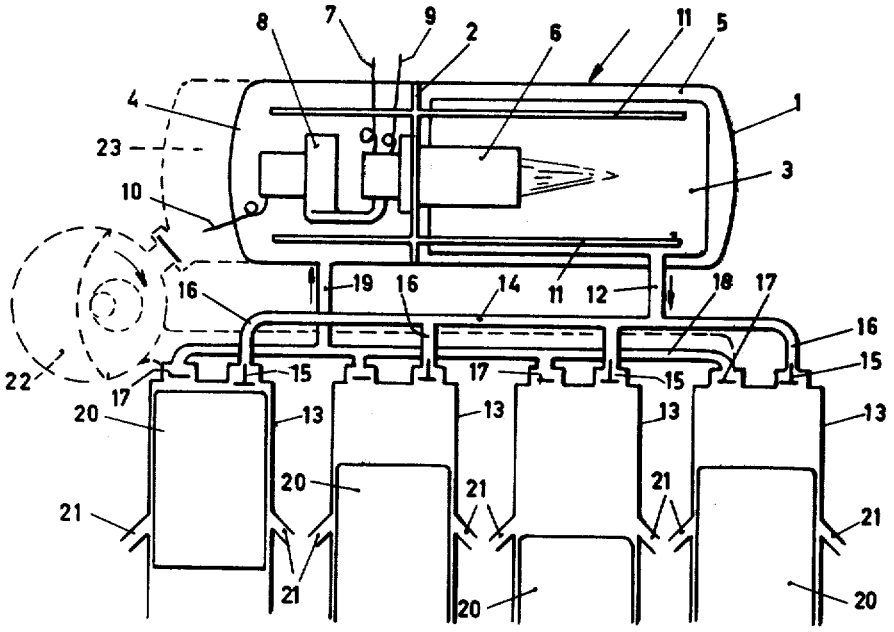

FIG. 3
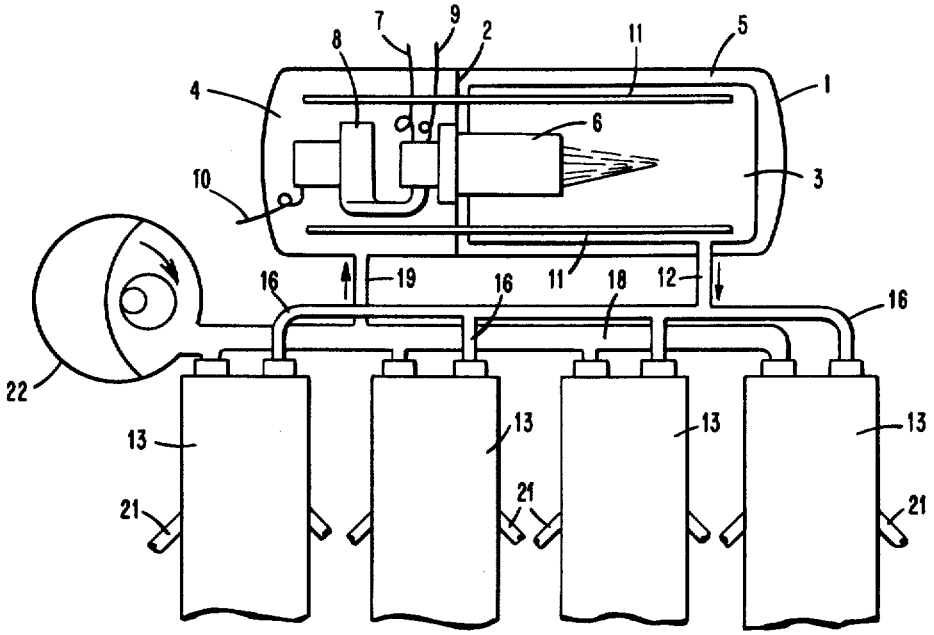
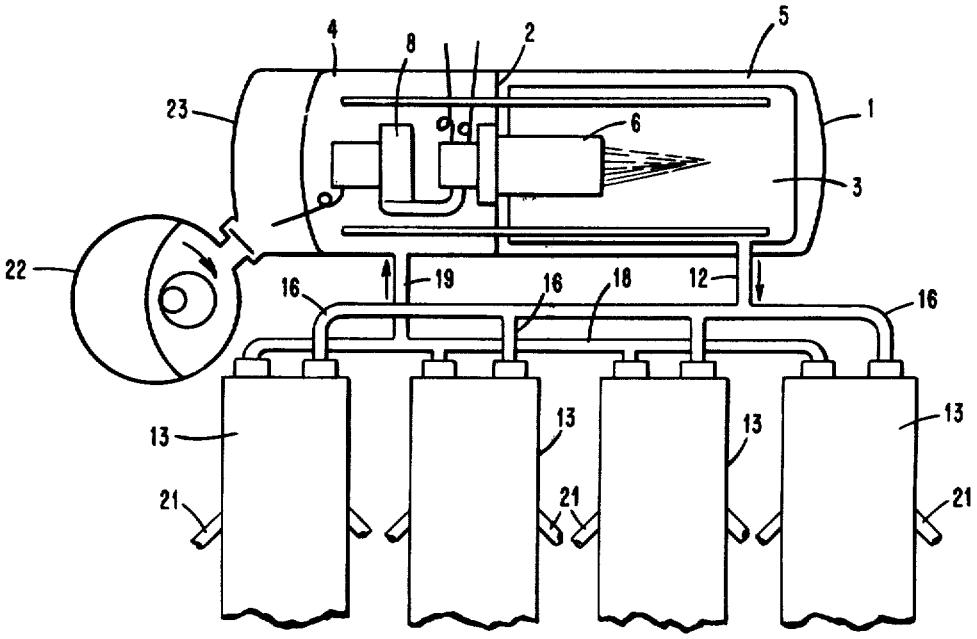
FIG. 4

DEVICE COMPRISING AN EXPANSION ENGINE AND A SEPARATE APPARATUS FOR FEEDING SAID ENGINE

This is a continuation of application Ser. No. 193,636, filed Oct. 29, 1971, now abandoned.

The present invention aims at regulating the combustion of the fuel in such a manner that it is substantially complete.

This is accomplished by the method according to the present invention in that said separate apparatus comprises a housing sub-divided into a first and a second chamber by means of a partition, at least one burner being arranged in said partition, said first chamber being connected by a conduit to the cylinder of said expansion engine for supplying air under pressure by said expansion engine to said first chamber, a non-return valve being provided in said conduit, the first chamber supplying air under pressure contained therein continuously to said burner, means being provided for continuously supplying fuel to said burner, the combustion of said fuel taking place in the second chamber, said second chamber being connected by a conduit to an inlet valve of the cylinder of the expansion engine, means being provided for controlling the supply of fuel to said burner and for supplying combustion gases to said expansion engine.

The expansion engine which is fed by said arrangement may be of such construction that said arrangement takes a substantially constant amount of the mixture of combustion gases and air from the second chamber. In this instance the offtake of said mixture from the second chamber is always so great as to cause the required amount of air to flow through the burner. If in view of the nature of the expansion engine slight differences in the gas mixture in the second chamber would occur, these may be remedied by a corresponding selection of the dimensions of said second chamber.

If, however, under certain circumstances greater differences would present themselves, it is possible according to the invention that in the first chamber of the housing at least one blower is mounted which delivers the combustion air to the or each burner at a pressure which is somewhat higher than the pressure prevailing in said first chamber. This prevents the combustion from being impeded or even rendered entirely impossible. Said blower, moreover presents the advantage that at the starting of the expansion engine one is sure that the or each burner will continue to burn and that the flame will not backfire.

An additional possibility consists in using at a higher pressure ratio (in accordance with the possible nature of the linked-up expansion engine) both chambers may be interconnected by at least one pressure equalizing conduit which is also constructed as a heat seal. This is achieved by giving said equalizing conduit such length and such a cross-section that the combustion gases cannot flow back from the second chamber into the first chamber. According to the present invention the device may comprise an auxiliary means for receiving compressed air, said auxiliary means being connected via a valve means with the first mentioned chamber.

The expansion engine may comprise at least one cylinder having an air inlet valve connected with the second chamber and an air exhaust valve, said exhaust valve having a conduit which is connected via a compressor with the first chamber filled with compressed air. According to the present invention said conduit may also be connected via a compressor with a chamber connected to the first chamber.

The invention will be further explained below with reference to the drawings showing diagrammatically and by way of example three embodiments of the device according to the present invention, provided with a four cylinder piston expansion engine with scavenging possibility at the end of the piston stroke.

Figure 2:
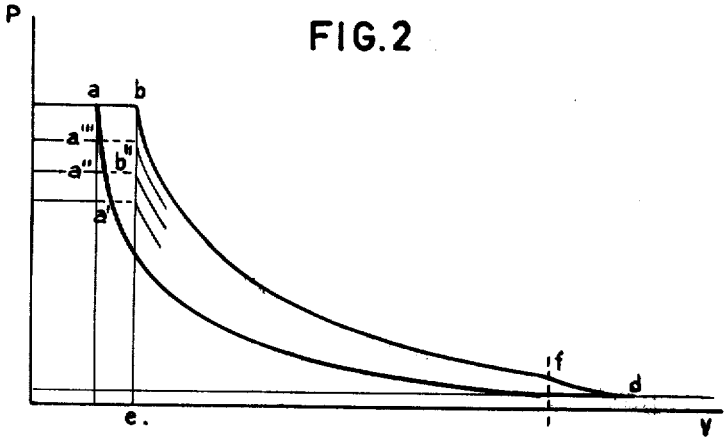

The drawings show in:

FIG. 1 a longitudinal section of said device,

FIG. 2 a work diagram,

FIG. 3 illustrates another embodiment of the device of the present invention, and FIG. 4 illustrates a still further embodiment of the device of the present invention.

The device shown in FIG. 1 comprises an apparatus having a housing 1 which is subdivided by a partition 2 into two chambers 3 and 4. Chamber 3 is provided with a heat-insulating lining 5. In the partion 2 there is provided a burner 6 which preferably may be of the type as described and shown on pages 86–88 of the periodical Business Week of January 22, 1955. Fuel is fed to said burner 6 by a conduit 7 comprising a regulating device (not shown) for the amount of fuel, and air is supplied to said burner by a blower 8. Said blower also ensures that the pressure in the chamber 4 is slightly higher than the pressure in the chamber 3.

The burner 6 is furthermore equipped with an electrical ignition to which current from a source of current (not shown) is supplied by a line 9. The blower 8 is connected to said source of current by a line 10. Both chambers 3 and 4 are in communication with each other by means of one or a number of tubes 11 serving as pressure equalizing tubes and also as a heat seal.

Chamber 3 is connected by a tube 12 with a tube 14 common for a number of cylinders 13, said tube 14 being connected via a tube 16 with a controlled inlet valve 15 of each of said cylinders. Each cylinder 13 comprises an outlet valve 17 of the non-return valve type, said valves communicating via a common tube 18 and a tube 19 with the chamber 4.

In each cylinder 13 there is provided a piston 20. The cylinders comprise outlet ports 21.

The operation of the afore-described expansion engine will be described below with reference to FIG. 2 for a vehicle equipped with such an expansion.

The expansion engine is thereby driven for example by an electric starter motor while, as soon as sufficient air passes through the burner, said burner is ignited which accelerates the pressuring and which, after intersecting the filling line e-b of the cylinders 13 brings about such a filling that the motor starts operating under its own power and consequently the starter motor may be cut out, for example in point *a'*. The burner is of such construction that always a complete combustion of the supplied fuel takes place. Because the expansion engine is driven by the starter motor an amount of air has been supplied to chamber 4 by the cylinders 13 at each stroke of the pistons located therein via the non-return valves 17 and the tubes 18 and 19, and consequently said chamber 4 as well as chamber 3, via the pressure equalizing tubes 11 and possibly via the blower 8, is filled with compressed air. The air contained in chamber 4 is fed by the blower 8 to the burner 6. The combustion gases being formed in chamber 3 are supplied via the tubes 12, 14 and 16 and the controlled inlet valves 15 to the cylinders 13 so that consequently from that moment onwards the expansion engine operates independently. By increasing the fuel supply one increases the amount of combustion gases in chamber 3 so that consequently via the pressure equalizing tubes 11 the pressure in chamber 4 likewise increases. As a result also the pressure in the cylinders 13 increases, for example from $a'$ to $a''$ which entails the effect of a larger filling as shown by $a''-b''$. This will continue at the increase of the fuel supply to the burner 6 until the maximum adjusted value $a-b$ is obtained at which the full power of the expansion engine is reached.

At $f$ the or each outlet port 21 of each cylinder, the piston of which has arrived at the end of its working stroke, is opened so that the combustion gases may escape from that cylinder and said cylinder is scavenged. At the return stroke of the piston in said cylinder the air contained in said cylinder is compressed and at the end of the stroke is delivered to chamber 4 via its non-return valve 17 and the tubes 18 and 19.

With this expansion engine it is remarkable that it is not dependent on a predetermined r.p.m. to produce a maximum driving power, because the power supplied by said expansion engine depends exclusively on the pressure prevailing in the arrangement, said pressure being determined by an amount of air delivered by the cylinders to chamber 4 by the fuel supply, therefore by the amount of combustion gases. In this way the advantage is obtained that in principle a change gear box is superfluous. If a change gear box is adopted, the engine, when running at a higher speed, may exercize a greater driving force on the vehicle at a lower velocity of the vehicle.

It is obvious that the arrangement according to the invention is not restricted to the embodiment shown in the drawings and described in the specification, but that it can be designed in many ways without departing from the scope of the invention. For instance instead of a starter motor one may also apply a reservoir filled with compressed air with the aid of which at the starting of the expansion engine pressurized air is supplied to chamber 4, which chamber during the operation of the expansion engine may be charged up to the desired or necessary minimum pressure.

If desired there may be provided a compressor 22 in the conduit 19, as shown in FIG. 3, said compressor delivering the air in said conduit under a high pressure to chamber 4 or as in FIG. 4 to an intermediate pressure vessel 23. The conduit 18 may have a greater volume, as likewise shown in FIG. 3, and consequently may serve as an intermediate pressure vessel.

What is claimed is:

1. A device comprising an expansion engine, having at least one cylinder provided with at least one scavenge port and with a piston moving therein, a separate apparatus for feeding said expansion engine with combustion gases under pressure, said separate apparatus comprising a housing with a heat insulating liner, said housing being subdivided into a first and a second chamber by means of a partition, at least one burner being mounted in said partition to receive all air from said first chamber and, and in such a way that the combustion takes place in the second chamber, said first chamber being connected by a conduit to the cylinder of said expansion engine for supplying air under pressure by said expansion engine to said first chamber, a non return valve being provided in said conduit which opens due to the compression of the air during the return stroke of the piston, said first chamber acting as the only source of supply of air under pressure for said burner, means for controlling a continuous supply of fuel and air to said burner in such amounts that a substantially complete combustion of said fuel in said second chamber is obtained, said second chamber being connected by a conduit to the cylinder of the expansion engine, a controlled valve being provided in said conduit for supplying combustion gases to the cylinder of said expansion engine.

2. A device according to claim 1, characterized in that the expansion engine comprises at least one cylinder having an inlet valve connected with the second chamber and an air exhaust valve, said exhaust valve having a conduit which is connected via a compressor with a chamber connected to the first chamber.

3. The device according to claim 1, characterized in that both chambers are interconnected by at least one conduit within which an equalizing of the pressure in both chambers take place which is also constructed as a heat seal.

4. The device according to claim 1, characterized in that in the first chamber of the housing at least one blower is mounted which delivers the combustion air to said burner at a pressure which is somewhat higher than the pressure prevailing in said first chamber.

5. The device according to claim 1, characterized in that the expansion engine comprises at least one cylinder having an inlet valve connected with the second chamber and an air exhaust valve, said exhaust valve having a conduit which is connected via a compressor with the first chamber filled with the means filled with compressed air.

6. The device according to claim 1, characterized in that the expansion engine comprises at least one cylinder having an inlet valve connected with the second chamber and an air exhaust valve, said exhaust valve having a conduit which is connected via a compressor with a chamber connected to the first chamber.

* * * * *